US007988760B2

(12) United States Patent
Lunk et al.

(10) Patent No.: US 7,988,760 B2
(45) Date of Patent: Aug. 2, 2011

(54) METHOD OF MAKING NANOCRYSTALLINE TUNGSTEN POWDER

(75) Inventors: Hans-Joachim Lunk, Towanda, PA (US); Henry J. Stevens, Athens, PA (US)

(73) Assignee: Global Tungsten & Powders Corp., Towanda, PA (US)

( * ) Notice: Subject to any disclaimer, the term of this patent is extended or adjusted under 35 U.S.C. 154(b) by 0 days.

(21) Appl. No.: 12/036,507

(22) Filed: Feb. 25, 2008

(65) Prior Publication Data

US 2008/0223175 A1 Sep. 18, 2008

Related U.S. Application Data

(60) Provisional application No. 60/906,795, filed on Mar. 13, 2007.

(51) Int. Cl.
*B22F 9/22* (2006.01)

(52) U.S. Cl. ..... 75/369; 75/623
(58) Field of Classification Search ..... 75/369
See application file for complete search history.

(56) References Cited

U.S. PATENT DOCUMENTS 5,230,729 A * 7/1993 McCandlish et al. ..... 75/351
5,352,269 A * 10/1994 McCandlish et al. ..... 75/351
6,129,890 A * 10/2000 Lunk et al. ..... 419/4
7,470,309 B2 * 12/2008 Kim et al. ..... 75/351

* cited by examiner

*Primary Examiner* — George Wyszomierski
(74) *Attorney, Agent, or Firm* — Ballard Spahr LLP

(57) ABSTRACT

There is described a method of making a nanocrystalline tungsten powder that comprises: (a) heating a tungsten-containing material in a reducing atmosphere at an intermediate temperature of from about 600° C. to about 700° C. for an intermediate time period; the tungsten-containing material being selected from ammonium paratungstate, ammonium metatungstate or a tungsten oxide; and (b) increasing the temperature to a final temperature of about 800° C. to about 1000° C. for a final time period.

10 Claims, 3 Drawing Sheets

METHOD OF MAKING NANOCRYSTALLINE TUNGSTEN POWDER

CROSS REFERENCES TO RELATED APPLICATIONS

This application claims the benefit of U.S. Provisional Application No. 60/906,795, filed Mar. 13, 2007, which is incorporated herein by reference.

BACKGROUND OF THE INVENTION

Depleted uranium (DU) has been a highly effective material for armor-piercing projectiles that are used against hardened targets and heavily armored vehicles. In addition to their high density and strength, DU kinetic-energy penetrators possess a unique ability to self-sharpen as they impact a target. This self-sharpening behavior is a result of adiabatic shear that occurs within the DU. Unfortunately, DU also possesses a certain low level of radioactivity and the use of DU penetrators is causing concern recently among those soldiers who are exposed to them.

Tungsten because of its comparable density would be an effective replacement for DU in kinetic-energy penetrators except for the fact that tungsten does not exhibit the self-sharpening behavior. Instead tungsten projectiles tend to flatten upon impact. In order to overcome the resistance of tungsten to form the shear bands that cause the self-sharpening behavior, it has been proposed to use nanostructured materials including nanocrystalline tungsten alloys and composites. Of course, the ability to fully investigate and implement these solutions depends to a degree on the availability of sufficient quantities of nanocrystalline tungsten powders.

Therefore, it would be an advantage to have a process to make nanocrystalline tungsten powders which could be used in such applications.

SUMMARY OF THE INVENTION

It is an object of the invention to obviate the disadvantages of the prior art.

It is another object of the invention to provide a method for making nanocrystalline tungsten powders.

In accordance with an object of the invention, there is provided a method of making a nanocrystalline tungsten powder that comprises:

(a) heating a tungsten-containing material in a reducing atmosphere at an intermediate temperature of from about 600° C. to about 700° C. for an intermediate time period; the tungsten-containing material being selected from ammonium paratungstate, ammonium metatungstate or a tungsten oxide; and (b) increasing the temperature to a final temperature of about 800° C. to about 1000° C. for a final time period.

The reducing atmosphere preferably comprises a hydrogen gas and more preferably consists essentially of dry hydrogen (~−40° C. dew point). Other useful gas mixtures for the reducing atmosphere may include $H_2/N_2$, $H_2$/Ar, and $H_2$/He gas mixtures and even ammonia or hydrazine. The intermediate temperature is preferably about 650° C. and the intermediate time period is preferably at least 2 hours. A preferred final temperature is about 900° C. and the final time period is preferably at least 1 hour.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

As used herein, the term "nanocrystalline tungsten powders" means tungsten powders having crystallites that are less than about 200 nm in size.

Reduction tests were carried out in a laboratory-scale furnace using the following tungsten-containing starting materials: ammonium paratungstate tetrahydrate (APT), $(NH_4)_{10}[H_2W_{12}O_{42}]\cdot 4H_2O$, spray-dried ammonium metatungstate trihydrate (AMT), $(NH_4)_6[H_2W_{12}O_{40}]\cdot 3H_2O$, freeze-dried AMT, and several tungsten oxides including tungsten trioxide ($WO_3$), and the tungsten blue oxides, $WO_{2.6}$, $WO_{2.973}$, and $WO_{2.911}$. The properties of the tungsten oxide starting materials are given in Table 1.

TABLE 1

| | Tungsten Oxide Starting Materials | | | |
|---|---|---|---|---|
| Characterization | $WO_3$ | $WO_{2.60}$ | $WO_{2.973}$ | $WO_{2.911}$ |
| Overall Composition | $WO_3$ | $WO_{2.60}$ | $0.124NH_3\cdot 0.133H_2O\cdot WO_{2.973}$ | $0.066NH_3\cdot 0.092H_2O\cdot WO_{2.911}$ |
| Phases (XRD) | $WO_3$ (100%) | $WO_{2.72}$ (84%) $WO_{2.00}$ (16%) | hexag W bronze/ orthorh. $WO_3$/ amorph. fraction | hexag. W bronze (30%) orthorh. $WO_3$ (25%) $WO_{2.90}$ (15%) amorph. (30%) |
| Bulk Density ($g/cm^3$) | 2.85 | 2.13 | 2.91 | 2.70 |
| Tap Density ($g/cm^3$) | 3.64 | 2.90 | 3.73 | 3.53 |
| Hall Flow (sec/50-g) | ∝ | ∝ | 34 | ∝ |
| K (ppm) | <10 | <10 | <10 | <10 |
| Na (ppm) | <5 | <5 | <5 | <5 |
| As-is $D_{50}$ (μm) | 24.7 (bimodal) | 8.65 (bimodal) | 19.8 (unimodal) | 25.5 (unimodal) |

TABLE 1-continued

| Characterization | Tungsten Oxide Starting Materials | | | |
|---|---|---|---|---|
| | $WO_3$ | $WO_{2.60}$ | $WO_{2.973}$ | $WO_{2.911}$ |
| Rod-milled $D_{50}$ (μm) | 0.83 (bimodal) | 1.15 (bimodal) | 3.89 (bimodal) | 4.06 (trimodal) |

Freeze-dried AMT was made by dropwise additions into liquid nitrogen of 30-mL volumes of an AMT solution (1,373 g AMT in 1,000 g water) using a burette. The flask with the frozen droplets was freeze-dried by using a commercial freeze dry system from Labconco Corp.

Figure 1:
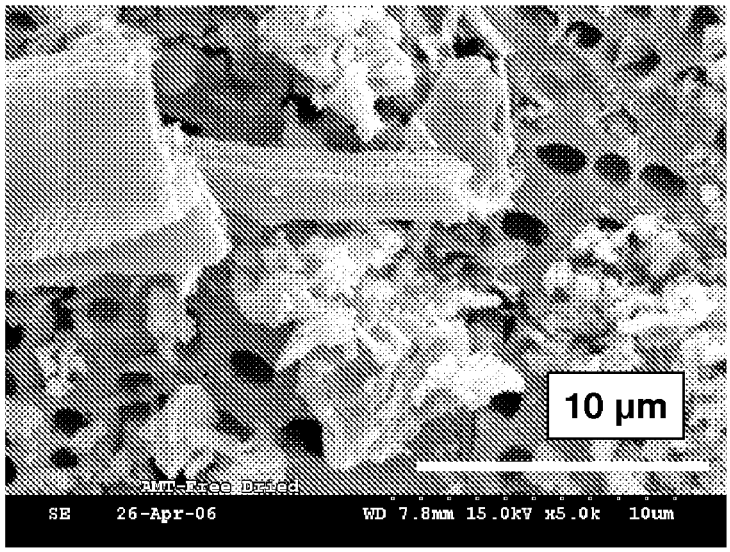
FIGS. 1 and 2 are SEM photomicrographs of freeze-dried AMT.
Figure 2:
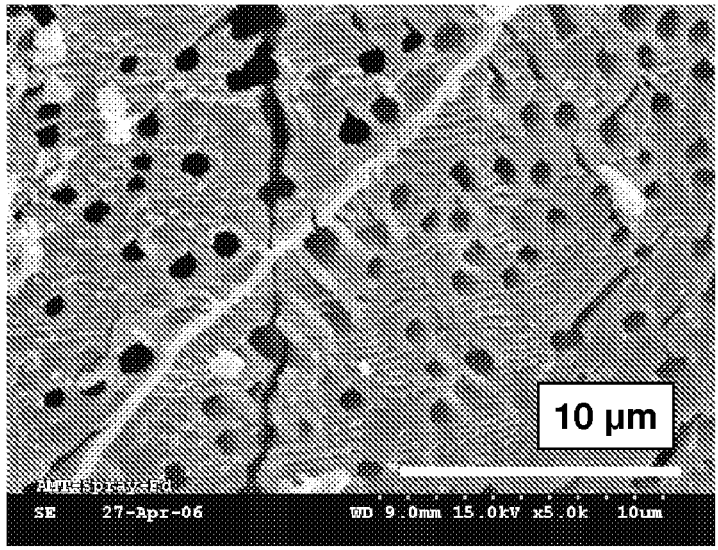
Figure 3:
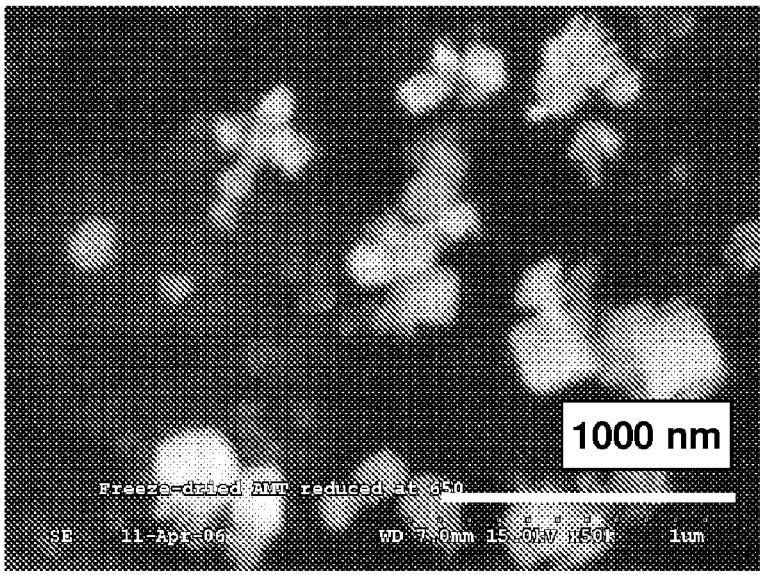
FIGS. 3 and 4 are SEM photomicrographs of freeze-dried AMT reduced at 650° C.
Figure 4:
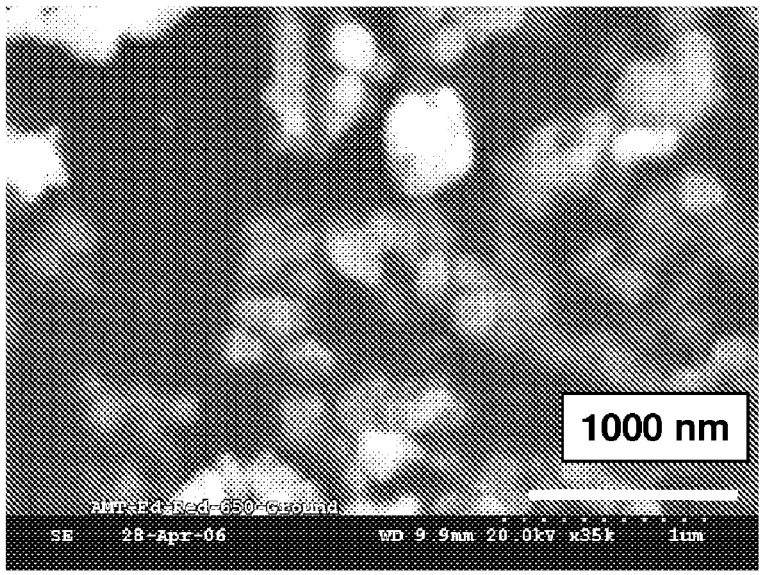

A small nickel crucible was loaded with 4-5 g of freeze-dried AMT and reduced in hydrogen in a laboratory furnace. A constant ramp of 6K/min and four different reduction regimes were used, specifically a 16-hr hold at 650° C., a 5-hr hold at 650° C. plus a 2-hr final hold at 900° C., a 1-hr hold at 900° C., and a 2-hr hold at 900° C., respectively. After cooling the sample in hydrogen down to about 250° C., the furnace was flushed with nitrogen and the crucible was moved into the cooling zone, cooled, and then removed. All samples preserved the shape of the starting droplets and were not pyrophoric. The oxygen content of the four samples was found to be 7000, 2600, 2800 and 1500 ppm, respectively. FIGS. 1 and 2 are photomicrographs of the porous freeze-dried AMT taken with a scanning electron microscope (SEM). FIGS. 3 and 4 are SEM photomicrographs of the tungsten powders reduced at 650° C. Tungsten particles with a size of about 100 nm are readily identifiable.

Figure 5:
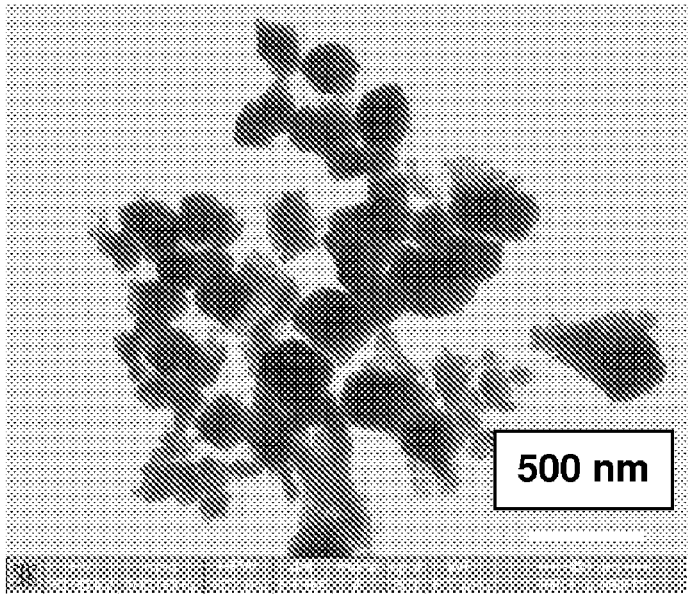
FIG. 5 is an STEM photomicrograph of W powder made from freeze-dried AMT (×100,000).
Figure 6:
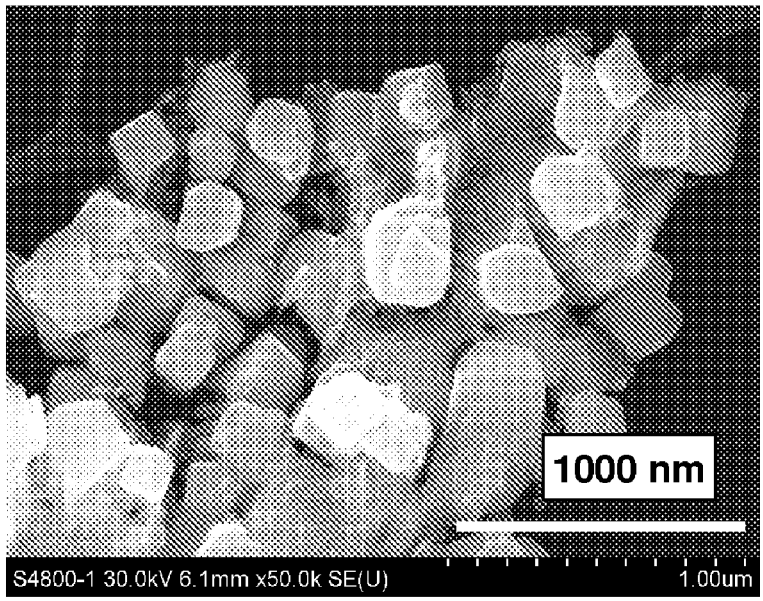
FIG. 6 is an SEM photomicrograph of W powder made from spray-dried AMT (×50,000).

In addition, 5-g amounts of freeze-dried AMT and spray-dried AMT were reduced in parallel in hydrogen in a laboratory furnace. A constant ramp of 6K/min and three different reduction regimes were used, specifically a 16-hr hold at 650° C., a 10-hr hold at 750° C. and a 1-hr hold at 900° C., respectively. After cooling the samples in hydrogen down to about 50° C., they were flushed with nitrogen, moved into the cooling zone, cooled, and then removed. All samples were not pyrophoric. Oxygen content, BET surface area and particle size ($D_{50}$) (Microtrac Ultrafine Particle Analyzer) of the six tungsten powder samples are compiled in Table 2. Both starting AMT materials lead to nano-sized tungsten powders of a similar size. FIGS. 5 and 6 show scanning transmission electron microscope (STEM) and SEM photomicrographs, respectively, of tungsten powders reduced at 650° C. Tungsten particles with a size of about 200-nm and below are readily identifiable.

TABLE 2

Characterization of tungsten powders made from AMT

| Characterization | 5-g samples reduced at | | | | | |
|---|---|---|---|---|---|---|
| | 650° C. | | 750° C. | | 900° C. | |
| | Freeze-dried | Spray-dried | Freeze-dried | Spray-dried | Freeze-dried | Spray-dried |
| Oxygen (ppm) | 7200 | 7000 | 2200 | 2600 | 1400 | 1500 |
| BET ($m^2/g$) | 5.45 | 6.97 | 3.30 | 4.26 | 2.37 | 2.29 |
| $D_{50}$ (μm) | 0.39 | 1.03 | 0.78 | 0.58 | 0.50 | 0.59 |

Table 3 compiles the reduction conditions and the results of crystallite size determination of nanocrystalline tungsten powders made from the various starting materials. Crystallite size was measured by X-ray diffraction (XRD) using XRD-JADE-7 software (Materials Data Inc.) The calculation is based on the fact that as the crystallite size decreases the normally sharp diffraction maxima first become broader at their base, then broaden uniformly throughout until, finally, they become so broad that they are no longer clearly visible. The expression for the "particle-size-broadening" (Scherrer) is $B=K\cdot\lambda/L\cdot\cos\theta$, where B is the broadening of the line expressed in units of $2\theta$, K is a constant approximately equal to 1, L is the average length of the crystallite, $\lambda$ is the wavelength of the X-ray used and $\theta$ is the Bragg angle.

TABLE 3

| | 6" long round boat | | | Crystallite Size (nm) if No strain | | | | | |
|---|---|---|---|---|---|---|---|---|---|
| | 6 K/min | | | 6 peaks | | | 7 peaks | | |
| Starting Material | Sample Size (g) | Hold at 650° C. | Hold at 900° C. | All peaks | 3 middle peaks | Median peak | All peaks | 3 middle peaks | Median peak |
| $WO_{2.60}$ | 70 | NO | 1 hr | | | | 134-230 | 161-177 | 167 |
| | 210 | NO | 2 hrs | | | | 252->500 | 275-297 | 289 |
| | 70 | 1 hr | 1 hr | | | | 94-153 | 113-126 | 122 |
| | 210 | 2 hrs | 2 hrs | | | | 174-281 | 199-215 | 213 |
| | 210 | 10 hrs | 1 hr | | | | 91-148 | 96-98 | 98 |
| $WO_{2.973}$ | 20 | NO | 1 hr | | | | 195-344 | 213-263 | 240 |
| | 300 | NO | 2 hrs | | | | 304->500 | 408->500 | 442 |
| | 20 | 2 hrs | 1 hr | | | | 90-117 | 93-99 | 94 |
| | 300 | 2 hrs | 2 hrs | | | | 137-213 | 147-156 | 149 |
| | 210 | 10 hrs | 1 hr | | | | 57-118 | 62-68 | 63 |
| $WO_{2.911}$ | 20 | NO | 1 hr | | | | 85-123 | 93-112 | 94 |
| | 20 | 2 hrs | 1 hr | | | | 59-88 | 64-77 | 74 |
| $WO_3$ | 70 | NO | 1 hr | 52-81 | 63-67 | 65 | | | |
| | 210 | NO | 2 hrs | 70-107 | 77-83 | 80 | | | |
| | 70 | 1 hr | 1 hr | 58-76 | 60-64 | 62 | | | |
| | 210 | 2 hrs | 2 hrs | 65-99 | 79-80 | 80 | | | |
| AMT | 70 | NO | 1 hr | 96-143 | 102-104 | 103 | | | |
| | 210 | NO | 2 hrs | 157-263 | 173-215 | 194 | | | |

TABLE 3-continued

| | 6" long round boat | | | Crystallite Size (nm) if No strain | | | | | |
|---|---|---|---|---|---|---|---|---|---|
| | 6 K/min | | | 6 peaks | | | 7 peaks | | |
| Starting Material | Sample Size (g) | Hold at 650° C. | Hold at 900° C. | All peaks | 3 middle peaks | Median peak | All peaks | 3 middle peaks | Median peak |
| | 70 | 2 hrs | 1 hr | 80-120 | 86-88 | 87 | | | |
| | 210 | 2 hrs | 2 hrs | | | | 122-150 | 128-143 | 138 |
| | 210 | 10 hrs | 1 hr | | | | 61-97 | 65-67 | 66 |
| APT | 100 | NO | 1 hr | | | | 127-184 | 130-153 | 130 |
| | 300 | NO | 2 hrs | | | | 135-244 | 140-178 | 150 |
| | 100 | 2 hrs | 1 hr | | | | 83-127 | 86-91 | 89 |
| | 300 | 2 hrs | 2 hrs | | | | 119-265 | 126-138 | 131 |
| | 210 | 10 hrs | 1 hr | | | | 65-96 | 66-68 | 67 |

The above results show that in most cases a reduction regime with a hold at 650° C. leads to powders with the smallest crystallite size as compared with the reduction without a hold at 650° C. It is believed that at temperatures between about 600° C. to about 700° C. a large amount of nuclei are produced which lead to smaller crystallites. It was further determined that the lower the bed height (smaller sample size) and the longer the hold time at about 650° C. the smaller the crystallite size and that reduction of $WO_3$, $WO_{2.6}$, AMT and APT resulted in tungsten powders with the smallest crystallite size.

A further advantage is that the method of this invention does not require any milling to make nanocrystalline (<200 nm) tungsten powders, which prevents the otherwise unavoidable contamination of the tungsten powder.

While there have been shown and described what are at present considered to be preferred embodiments of the invention, it will be apparent to those skilled in the art that various changes and modifications can be made herein without departing from the scope of the invention as defined by the appended claims.

We claim:

1. A method of making a nanocrystalline tungsten powder, comprising:

a) heating a tungsten-containing material in a reducing atmosphere at an intermediate temperature of from about 600° C. to about 650° C. for an intermediate time period of at least 2 hours; the tungsten-containing material being selected from ammonium paratungstate, ammonium metatungstate, or a tungsten oxide; and b) increasing the temperature to a final temperature of about 800° C. to about 1000° C. for a final time period.

2. The method of claim 1 wherein the reducing atmosphere comprises hydrogen gas.

3. The method of claim 1 wherein the intermediate temperature is about 650° C.

4. The method of claim 1 wherein the final temperature is about 900° C.

5. The method of claim 1 wherein the final time period is at least 1 hour.

6. A method of making a nanocrystalline tungsten powder, comprising:

a) heating a tungsten-containing material in a hydrogen-containing atmosphere at an intermediate temperature of from about 600° C. to about 650° C. for an intermediate time period of at least 2 hours; the tungsten-containing material being selected from ammonium paratungstate, ammonium metatungstate, or a tungsten oxide; and b) increasing the temperature to a final temperature of about 800° C. to about 1000° C. for a final time period.

7. The method of claim 6 wherein the intermediate temperature is about 650° C.

8. The method of claim 7 wherein the final temperature is about 900° C. and the final time period is at least 1 hour.

9. The method of claim 8 wherein the hydrogen-containing atmosphere consists essentially of dry hydrogen.

10. The method of claim 6 wherein the hydrogen-containing atmosphere is selected from an $H_2/N_2$, $H_2/Ar$, $H_2/He$ gas mixture.

* * * * *